US006979287B2

(12) United States Patent
Elbaz et al.

(10) Patent No.: US 6,979,287 B2
(45) Date of Patent: Dec. 27, 2005

(54) PROPRIOCEPTIVE AND KINESTHETIC FOOTWEAR

(76) Inventors: Avi Elbaz, 11 HaPisga Street, Dimona 86000 (IL); Amit Mor, 9 Smilanski Street, Rehovot 76446 (IL)

( * ) Notice: Subject to any disclaimer, the term of this patent is extended or adjusted under 35 U.S.C. 154(b) by 130 days.

(21) Appl. No.: 10/222,992

(22) Filed: Aug. 19, 2002

(65) Prior Publication Data

US 2004/0033874 A1 Feb. 19, 2004

(51) Int. Cl.[7] ..... A63B 71/00
(52) U.S. Cl. ..... 482/148; 36/61; 36/134; 36/127
(58) Field of Search ..... 482/148, 70–72; 36/61, 134, 67 R, 67 D, 127–129, 28

(56) References Cited

U.S. PATENT DOCUMENTS 5,337,494 A * 8/1994 Ricker ..... 36/61
5,533,282 A * 7/1996 Kataoka et al. ..... 36/129
D448,920 S * 10/2001 Montross et al. ..... D2/954
6,315,786 B1 * 11/2001 Smuckler ..... 606/201

* cited by examiner

*Primary Examiner*—Gregory L. Huson
*Assistant Examiner*—L. Amerson
(74) *Attorney, Agent, or Firm*—Dekel Patent Ltd.; David Klein

(57) ABSTRACT

Footwear comprising a support member having an upper surface attachable to a foot, and two bulbous protuberances, each having a curved outer contour, protruding from a lower surface thereof, one of the protuberances being positioned more posteriorly than the other of the protuberances.

14 Claims, 4 Drawing Sheets

PROPRIOCEPTIVE AND KINESTHETIC FOOTWEAR

FIELD OF THE INVENTION

The present invention relates generally to footwear for training, developing and enhancing proprioceptive and kinesthetic skills and neuromuscular control

BACKGROUND OF THE INVENTION

Proprioception refers to the ability to know where a body part is located in space and to recognize movements of body parts (such as fingers and toes, feet and hands, legs and arms). Kinesthesia is a related term, and refers to the sensation by which position, weight, muscle tension and movement are perceived. In some of the medical literature, proprioception refers to the conscious and unconscious appreciation of joint position, while kinesthesia refers to the sensation of joint velocity and acceleration. Proprioception is often used interchangeably with kinesthesia, and herein as well, the terms will be used interchangeably.

The neuromuscular control system of the body integrates peripheral sensations relative to joint loads and processes these signals into coordinated motor responses. This muscle activity serves to protect joint structures from excessive strain.

Certain mechanoreceptors are present throughout the soft tissues of the musculoskeletal system which interact with the central nervous system and coordinate body movements, postural alignment, and balance. Mechanoreceptors are located in the muscles, tendons, ligaments, joint capsules and the skin. These nerve fibers provide information to the brain regarding the status and function of the musculoskeletal system. The mechanoreceptors send electrical signals along peripheral nerves to the spinal cord. The electrical signals travel via the spinal cord to the brain where the signals are interpreted to recognize movements of body parts, muscle tension, movement and the like.

Some examples of mechanoreceptors for controlling the muscular system include muscle spindles. Muscle spindles are found interspersed within the contractile fibers of skeletal muscles, with the highest concentration in the central portion of each muscle. Muscle spindle fibers respond to changes in the length of muscles. These nerve endings provide the central nervous system information used to maintain muscle tone and the correct muscle tension on opposite sides of each joint.

Fibrous tissues that surround and protect most joints generally contain a variety of sensory nerve endings for proprioception and kinesthesia. The input from these sensory nerve endings provides the central nervous system information regarding the location, stretch, compression, tension, acceleration, and rotation of the joint.

The foot is the anatomical region that contains the second largest number of proprioceptive or kinesthetic sensory receptors in the body (the spine has the most).

Proprioceptive and kinesthetic exercises and exercise devices are well known for improving agility, balance and coordination, and for rehabilitation of persons whose proprioceptive ability has been impaired, such as after accidents or illness. One such class of exercise devices includes tilt boards, wherein a patient stands on a board or similar platform that has a ball mounted underneath. The board does not lie horizontal due to the presence of the ball, and this challenges the ability of the patient to balance and perform maneuvers on the platform. Repeated exercises on the tilt board may be used to develop or rehabilitate the proprioception and neuromuscular control of the patient, as well as strengthen muscles, tendons and connective tissues in the foot area.

Other known proprioceptive and kinesthetic exercise devices include a shoe with a single ball mounted underneath the sole of the shoe. The shoe with the ball is used similar to the tilt board. Another kind of shoe has a rod mounted underneath the sole of the shoe, used for strengthening dorsiflexor muscles.

SUMMARY OF THE INVENTION

The present invention seeks to provide novel proprioceptive and kinesthetic exercise apparatus, which provides significant advantages over prior art apparatus, such as tilt boards or shoes with a single protrusion. As is described more in detail hereinbelow, the present invention includes two bulbous protrusions protruding from the underside of footwear, instead of the single ball of the prior art boards and shoes. The extra protrusion may significantly increase the possibilities and enable walking, and accelerate and improve the results of proprioceptive and kinesthetic treatment plans.

There is thus provided in accordance with an embodiment of the present invention footwear comprising a support member having an upper surface attachable to a foot, and two bulbous protuberances, each having a curved outer contour, protruding from a lower surface thereof, one of the protuberances being positioned more posteriorly than the other of the protuberances.

In accordance with an embodiment of the present invention the protuberances may or may not be positioned on a common longitudinal axis (e.g., the centerline or an axis offset from the centerline) of the support member.

Further in accordance with an embodiment of the present invention the protuberances may or may not be positioned on opposite sides of a latitudinal midline of the support member. For example, one of the protuberances may be positioned generally underneath a calcaneus support portion, a metatarsals support portion, or a phalanges support portion of the support member.

In accordance with an embodiment of the present invention at least one of the protuberances has a cross-section with a shape of a conic section, the conic section comprising at least one of a circle, ellipse, parabola and hyperbola.

The outer contour of one of the protuberances may or may not be shaped differently from the outer contour of another protuberance.

In accordance with an embodiment of the present invention at least one of the protuberances may be slidingly mounted on the support member.

Further in accordance with an embodiment of the present invention at least one of the protuberances may be adjustably attached to the support member such that the amount that the at least one of the protuberances protrudes from the support member is adjustable.

In accordance with another embodiment of the present invention the support member has a periphery in a shape of a shoe sole, and the footwear comprises a flange that extends outwards from the periphery of the support member. The flange may or may not comprise portions having differently curved contours or different degrees of hardness.

Further in accordance with an embodiment of the present invention the flange may or may not be adjustably attached to the support member such that the amount that the flange extends from the support member is adjustable.

There is also provided in accordance with an embodiment of the present invention a method for performing proprioceptive exercise, comprising attaching an upper surface of a support member to a foot, the support member comprising two bulbous protuberances that protrude from a lower surface of the support member, each protuberance having a curved outer contour, one of the protuberances being positioned more posteriorly than the other of the protuberances, and maneuvering while the foot is supported by at least one of the protuberances.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
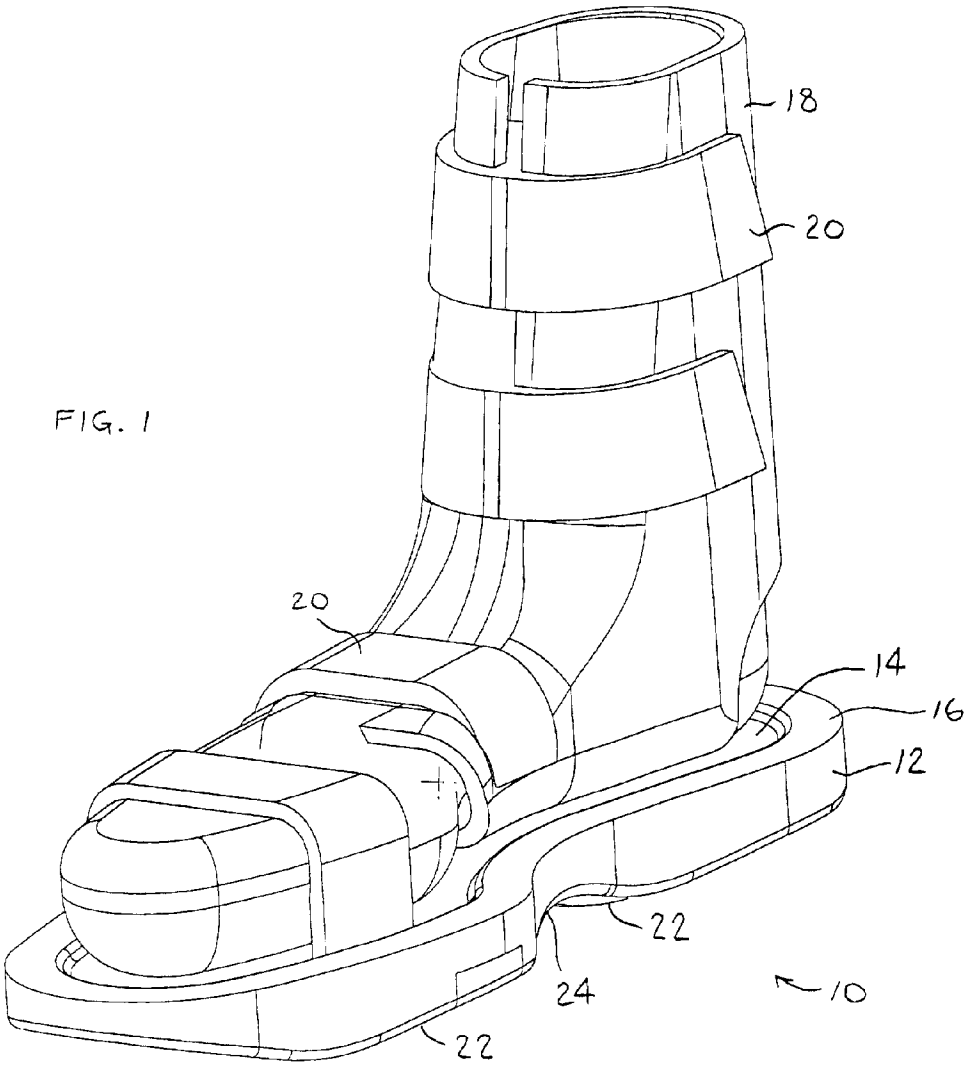
FIG. 1 is a simplified pictorial illustration of footwear constructed and operative in accordance with an embodiment of the present invention.

Reference is now made to FIGS. 1–4, which illustrate footwear 10 constructed and operative in accordance with an embodiment of the present invention. Footwear 10 may be supplied as one or more pairs of shoe-like devices, or alternatively, as just one of the shoe-like devices.

Footwear 10 preferably comprises a support member 12 having a periphery in a shape of a shoe sole with an upper surface 14. In the illustrated embodiment, the upper surface 14 is indented with a peripheral ridge 16, but it is appreciated that other configurations of upper surface 14 are within the scope of the invention. Footwear 10 may be attached to a foot of a user (not shown) by means of a boot 18 and/or fasteners 20, such as but not limited to, VELCRO straps, buckles, shoe laces, and the like. Boot 18 may be fashioned for attachment to the user's foot with or without fasteners 20. Similarly, fasteners 20 may be used to attach footwear 10 to the user's foot without boot 18.

Two bulbous protuberances 22 may protrude from a lower surface 24 of support member 12. Each protuberance 22 may have a curved outer contour 26. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. For example, the contours 26 may have the shape of a conic section, that is, the shape of a circle, ellipse, parabola or hyperbola. The various cross-sections of the contours 26 of protuberance 22 may be shaped identically or differently.

Figure 2:
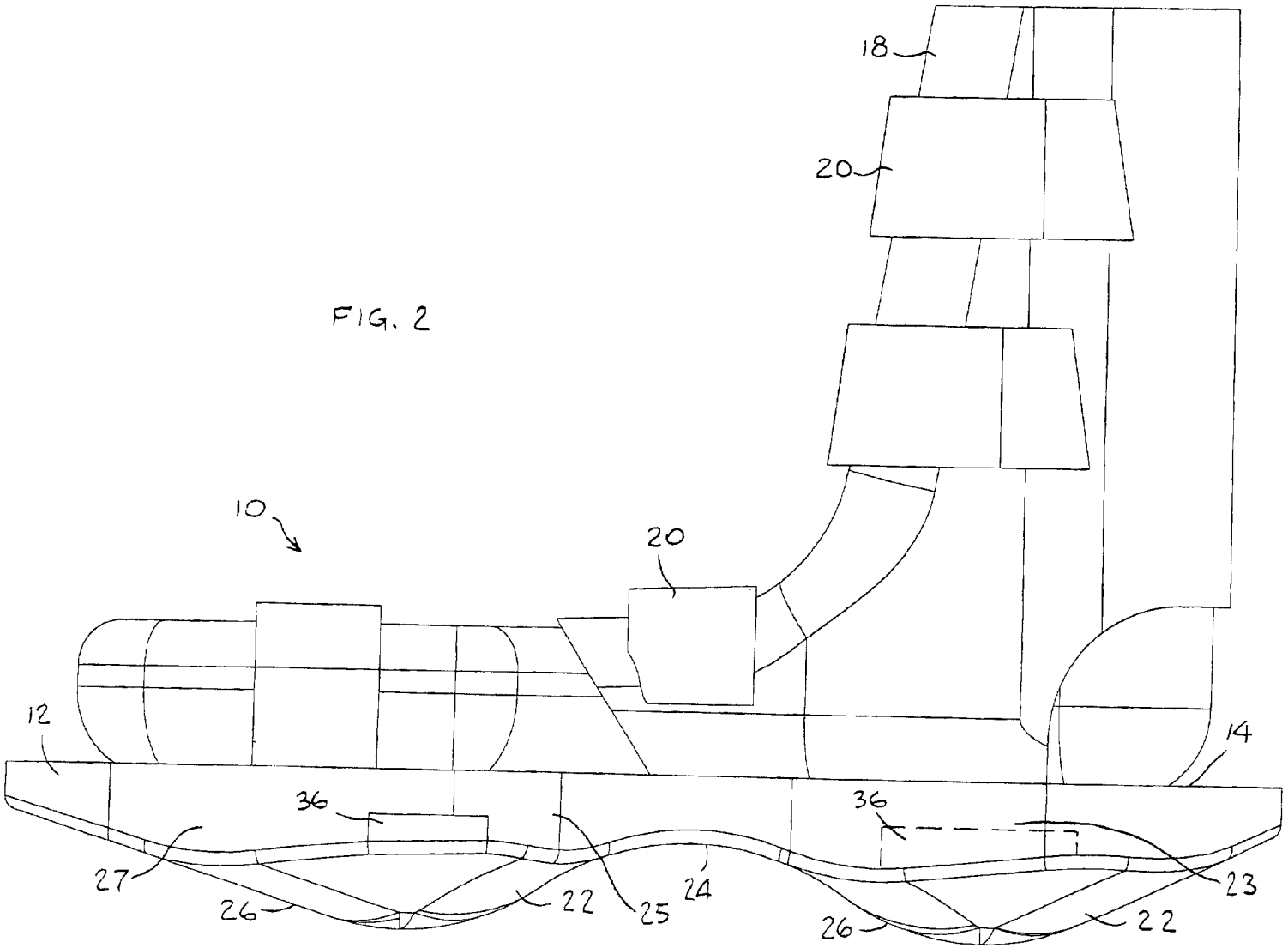
FIGS. 2 and 3 are simplified side-view and rear-view illustrations, respectively, of the footwear of FIG. 1.
Figure 4:
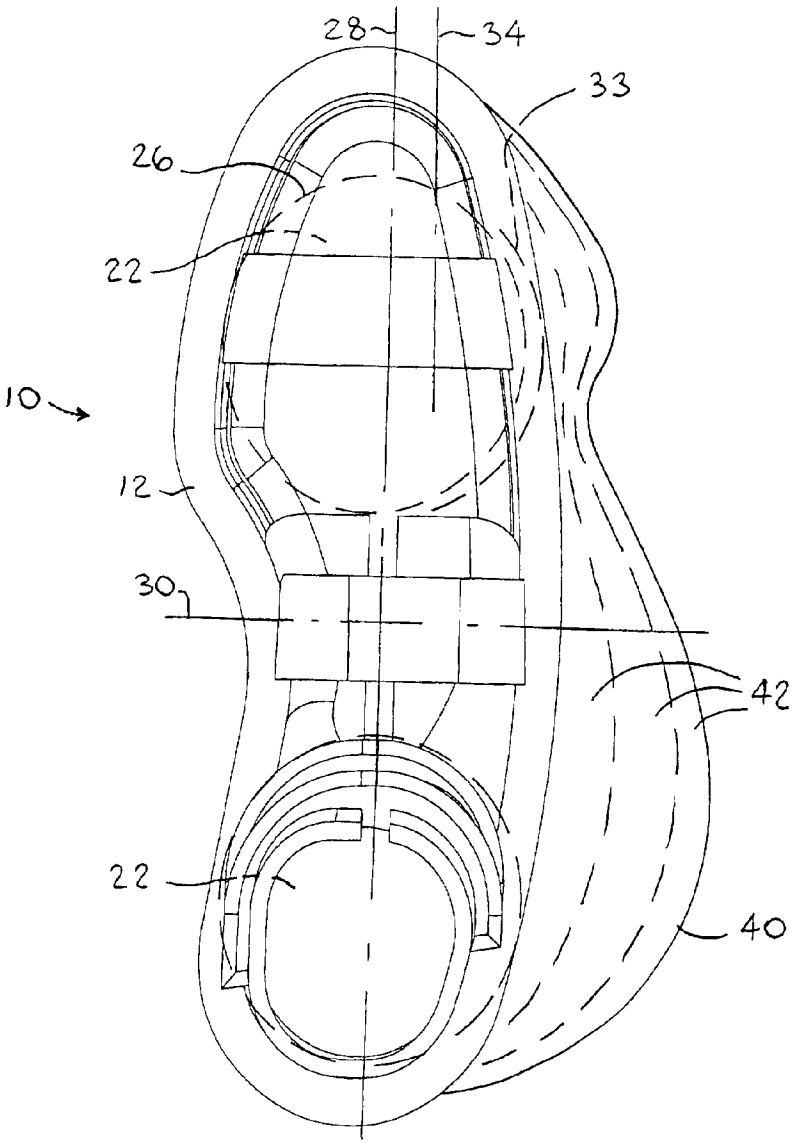
FIG. 4 is a simplified top-view illustration of the footwear of FIG. 1, showing further features of other embodiments of the present invention.

As seen clearly in FIG. 2, one protuberance 22 may be positioned more posteriorly than the other protuberance 22. As seen in FIG. 4, the protuberances may be positioned on a common longitudinal axis of support member 12, such as the centerline 28 of support member 12, and on opposite sides of the latitudinal midline 30. As seen in FIG. 2, the rearward protuberance 22 may be positioned generally underneath a calcaneus (heel, ankle) support portion 23 of support member 12, while the forward protuberance 22 may be positioned generally underneath a metatarsals support portion 25 and/or phalanges support portion 27 of support member 12.

Alternatively, as indicated by broken lines 33 in FIG. 4, one of the protuberances 22 (e.g., the forward one) may be aligned on a longitudinal axis 34 offset from centerline 28, and the rearward protuberance 22 may be positioned offset from axis 34, such as on the centerline 28. It is appreciated that the above are just some examples of positioning the protuberances 22, and many other possibilities exist within the scope of the invention.

The protuberances 22 may be constructed of any suitable material, such as but not limited to, elastomers or metal or a combination of materials, and may have different properties. For example, the protuberances may have different resilience or hardness, such as having different elasticity properties or Shore hardness. The protuberances 22 may protrude by different amounts from the lower surface 24 of support member 12.

In accordance with an embodiment of the present invention, one or more protuberances 22 may be slidingly mounted on support member 12. For example, protuberance 22 may be mounted on a track 36 (FIG. 2) formed in the lower surface 24 of support member 12, and may be selectively positioned anywhere along the track and fastened thereto. Track 36 may extend along a portion of the shoe sole or all along the length of the show sole. Alternatively or additionally, the amount of protrusion of protuberance 22 may be adjusted, such as by mounting protuberance 22 with a threaded fastener 38 (FIG. 3) to support member 12 and tightening or releasing threaded fastener 38.

Figure 3:
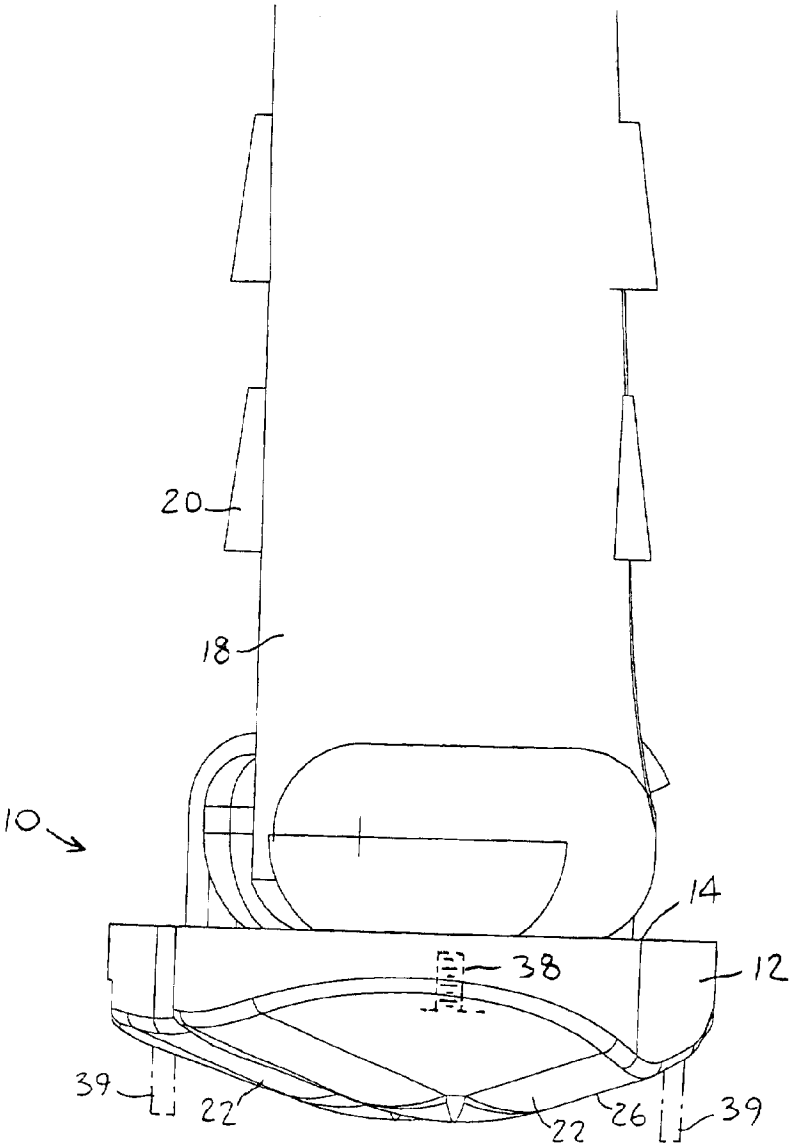

In accordance with an embodiment of the present invention, in addition to the bulbous protuberances 22, there further may be provided one or more non-bulbous protuberances 39, shown in FIG. 3. Protuberances 39 may be formed in the shape of a peg, stud, bolt, pin, dowel and the like, although the invention is not limited to these shapes. Protuberances 39 may be rigid or flexible. As with protuberances 22, the protuberances 39 may have different resilience or hardness, such as having different elasticity properties or Shore hardness, and they may protrude by different amounts from the lower surface 24 of support member 12. As above, the amount of protrusion of protuberances 39 may be adjusted. Protuberances 39 may be mounted at any place on the lower surface 24 of support member 12.

Reference is now made to FIG. 4. In accordance with an embodiment of the present invention, footwear 10 may comprise a flange 40 that extends outwards from the periphery of support member 12. In the illustrated embodiment, flange 40 extends sideways outwards from the periphery of support member 12, but it is appreciated that flange 40 may extend forwards or rearwards or in any other direction as well. Flange 40 may be provided on one side of footwear 10, as illustrated, or may be provided on both sides. Flange 40 may supplement the range of proprioceptive exercises possible with footwear 10, by providing an additional support surface during tilting and maneuvering with footwear 10.

Flange 40 may be constructed of any suitable material, such as but not limited to, elastomers or metal or a combination of materials, and may have portions 42 with different properties. For example, portions 42 may have different resilience or hardness, such as having different elasticity properties or Shore hardness. The portions 42 of flange 40 may have differently curved contours. Flange 40 may be adjustably attached to support member 12 such that the amount that flange 40 extends from support member 12 is adjustable.

A user may attach footwear 10 to his/her foot and perform a variety of maneuvers in a proprioceptive and/or kinesthetic exercise plan for the lower foot, upper leg and even upper torso and other body parts and organs. For example, footwear 10 may be used to reestablish neuromuscular control during rehabilitation of joints, to restore the mechanical and functional stability of the neuromuscular system, to improve or rehabilitate anticipatory (feed-forward) and reflexive (feed-back) neuromuscular control mechanism, and to regain and improve balance and postural equilibrium.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Footwear comprising:

a support member having an upper surface attachable to a foot, and two bulbous protuberances, each having a curved outer contour, protruding from a lower surface thereof, one of said protuberances being positioned more posteriorly than the other of said protuberances wherein said protuberances are attached to a centerline of said support member, said centerline extending from a calcaneus support portion of said support member to at least one of a metatarsals support portion and phalanges support portion of said support member, and wherein said protuberances are attached to said support member on opposite sides of a latitudinal midline of said support member, said latitudinal midline being halfway between a calcaneus support portion and a phalanges support portion of said support member, wherein said protuberances provide proprioceptive exercise to a wearer of the footwear.

2. Footwear according to claim 1, wherein one of said protuberances is fixedly attached to said support member generally underneath a calcaneus support portion of said support member.

3. Footwear according to claim 1, wherein one of said protuberances is fixedly attached to said support member generally underneath a metatarsals support portion of said support member.

4. Footwear according to claim 1, wherein one of said protuberances is fixedly attached to said support member generally underneath a phalanges support portion of said support member.

5. Footwear according to claim 1, wherein at least one of said protuberances has a cross-section with a shape of a conic section, said conic section comprising at least one of a circle, ellipse, parabola and hyperbola.

6. Footwear according to claim 1, wherein the outer contour of one of said protuberances is shaped differently from the outer contour of another protuberance.

7. Footwear comprising:

a support member having an upper surface attachable to a foot, and two bulbous protuberances, each having a curved outer contour, protruding from a lower surface thereof, one of said protuberances being positioned more posteriorly than the other of said protuberances, wherein at least one of said protuberances is movably mounted on said support member.

8. Footwear according to claim 7, wherein one of said protuberances protrudes further from the lower surface of said support member than another protuberance.

9. Footwear according to claim 7, wherein one of said protuberances is more resilient than another protuberance.

10. Footwear according to claim 7, wherein at least one of said protuberances is adjustably attached to said support member such that the amount that said at least one of said protuberances protrudes from said support member is adjustable.

11. Footwear according to claim 7, further comprising at least one non-bulbous protuberance mounted on the lower surface of said support member.

12. Footwear according to claim 11, comprising a plurality of said non-bulbous protuberances, wherein one of said non-bulbous protuberances protrudes further from the lower surface of said support member than another non-bulbous protuberance.

13. Footwear according to claim 11, comprising a plurality of said non-bulbous protuberances, wherein one of said non-bulbous protuberances is more resilient than another non-bulbous protuberance.

14. Footwear according to claim 11, wherein at least one of said non-bulbous protuberances is adjustably attached to said support member such that the amount that said at least one of said non-bulbous protuberances protrudes from said support member is adjustable.

* * * * *